US011099514B2

(12) United States Patent
Kamikawa et al.

(10) Patent No.: US 11,099,514 B2
(45) Date of Patent: Aug. 24, 2021

(54) IMAGE FORMING APPARATUS

(71) Applicant: BROTHER KOGYO KABUSHIKI KAISHA, Nagoya (JP)

(72) Inventors: Kazuya Kamikawa, Nagakute (JP); Yusuke Ikegami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 39 days.

(21) Appl. No.: 16/725,369

(22) Filed: Dec. 23, 2019

(65) Prior Publication Data

US 2020/0209798 A1 Jul. 2, 2020

(30) Foreign Application Priority Data

Dec. 26, 2018 (JP) ..... JP2018-243578

(51) Int. Cl.

| | |
|---|---|
| ***G03G 15/14*** | (2006.01) |
| ***G03G 15/00*** | (2006.01) |
| ***B41J 11/00*** | (2006.01) |
| *G03G 15/02* | (2006.01) |

(52) U.S. Cl.

CPC ..... *G03G 15/6529* (2013.01); *B41J 11/006* (2013.01); *G03G 15/757* (2013.01); *G03G 15/0216* (2013.01); *G03G 15/6547* (2013.01)

(58) Field of Classification Search

CPC ..... G03G 15/6529; G03G 15/6573; G03G 15/6582; G03G 15/757; B41J 11/006

See application file for complete search history.

(56) References Cited

U.S. PATENT DOCUMENTS

2015/0273891 A1* 10/2015 Tanjo ..... B41J 29/13 347/104
2015/0274469 A1 10/2015 Mori et al.
2020/0379397 A1* 12/2020 Agata ..... B65H 31/3027

FOREIGN PATENT DOCUMENTS

JP H05-201602 A 8/1993
JP H05-278918 A 10/1993
JP 2016-071224 A 5/2016

* cited by examiner

*Primary Examiner* — Hoang X Ngo
(74) *Attorney, Agent, or Firm* — Baker Botts L.L.P.

(57) ABSTRACT

An image forming apparatus includes a first transport unit, a second transport unit, a cover, a flap, a drive unit for moving the flap, a first sensor for detecting opening and closing of the cover, a second sensor for detecting a position of a sheet, and a controller. The controller switches the drive unit to move the flap to the second position, upon determining it is necessary to move the flap to the second position, subsequent to determining that the cover is opened based on a detection result by the first sensor. The controller switches the drive unit to move the flap from the second position to the first position, upon determining, based on a detection result by the second sensor, that a leading edge of the sheet reaches a position downstream, in a sheet transport direction, of a swing end portion of the flap at the second position.

9 Claims, 12 Drawing Sheets

IMAGE FORMING APPARATUS

CROSS-REFERENCE TO RELATED APPLICATION

This application claims priority from Japanese Patent Application No. 2018-243578 filed on Dec. 26, 2018, the content of which is incorporated herein by reference in its entirety.

TECHNICAL FIELD

Aspects of the disclosure relate to an image forming apparatus configured to form an image on both sides of a sheet.

BACKGROUND

A known image forming apparatus capable of duplex image forming has a main transport path for transporting a sheet transported from an image forming unit, a first discharge path for discharging the sheet transported from the main transport path to a discharge tray at an upper portion of a housing, and a return path branched from the main transport path for transporting the sheet upward and switching back the sheet, and then transporting the sheet downward back to the image forming unit.

The return path for inverting a sheet, which is provided separately from the first discharge path, allows the known image forming apparatus to form images on both sides of sheets at higher speed than an image forming apparatus having a single path for discharging and inverting a sheet.

SUMMARY

A known image forming apparatus has, in addition to a facedown discharge path for discharging a sheet with an image-recorded surface facing down onto a discharge tray, a straight discharge path for discharging straight a sheet transported from an image forming unit to an exterior of a housing. In this case, a curled sheet to be discharged straight may erroneously enter the facedown discharge path.

Aspects of the disclosure provide an image forming apparatus configured to discharge a sheet straight properly while preventing or reducing entry of a sheet into a first transport path leading to a discharge tray or into a second transport path branched from the first transport path.

According to one or more aspects of the disclosure, an image forming apparatus includes an image forming unit configured to form an image on a sheet, a housing, a first transport unit, a second transport unit, a cover, a flap, a drive unit, a first sensor, a second sensor, and a controller. The housing stores therein the image forming unit, includes a discharge tray at an upper portion thereof, and has a particular end. The first transport unit is configured to transport, along a first transport path, the sheet transported from the image forming unit to the discharge tray. The second transport unit is configured to transport, along a second transport path, the sheet transported from the image forming unit. The second transport path is branched from a junction with the first transport path and extends upward at a position closer to the particular end of the housing than the first transport path. The cover is disposed at the particular end of the housing pivotably relative to the housing and configured to, when closed, at least partially constitute the second transport unit and, when open, hold the sheet transported from the image forming unit to the exterior of the housing. The flap is disposed at the junction and swingable between a first position and a second position. The flap is configured to, when at the first position, block the second transport path and guide, along the first transport path, the sheet transported from the image forming unit and, when at the second position, block the first transport path and guide, along the second transport path, the sheet transported from the image forming unit. The drive unit is configured to move the flap between the first position and the second position. The first sensor is configured to detect opening and closing of the cover. The second sensor is configured to detect a position of the sheet transported toward the exterior of the housing. The controller is configured to switch the drive unit, based on results of detection by the first sensor and the second sensor, to move the flap. The controller is configured to switch the drive unit to move the flap to the second position, upon determining it is necessary to move the flap to the second position, subsequent to determining that the cover is opened based on a detection result by the first sensor. The controller switches the drive unit to move the flap from the second position to the first position, upon determining, based on a detection result by the second sensor, that a leading edge of the sheet reaches a position downstream, in a sheet transport direction, of a swing end portion of the flap at the second position.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment of the disclosure will be described with reference to the accompanying drawings.

Overall Structure of Image Forming Apparatus

Figure 1:
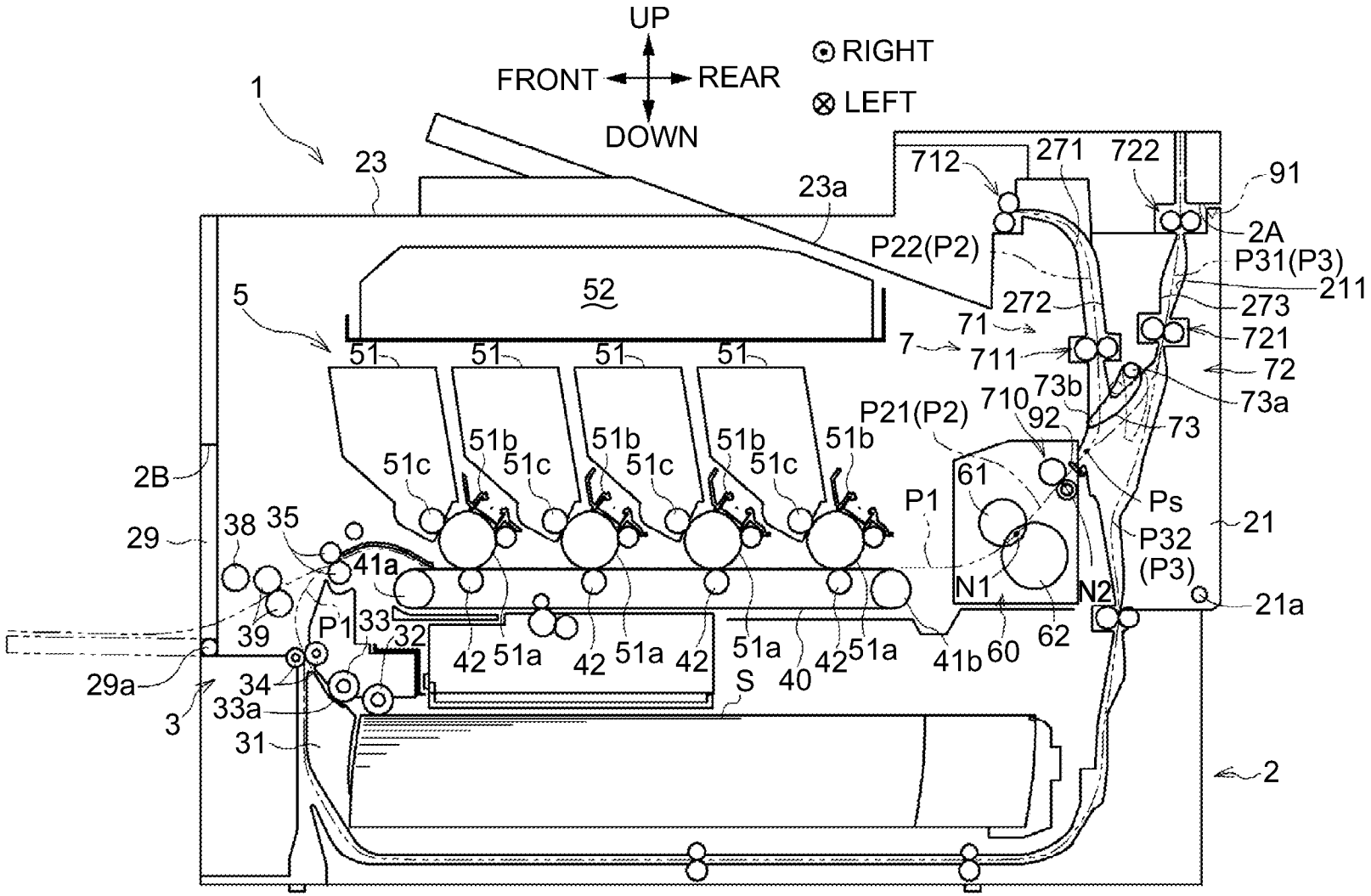
FIG. 1 is a central cross-sectional view of an image forming apparatus according to an illustrative embodiment of the disclosure.
Figure 2:
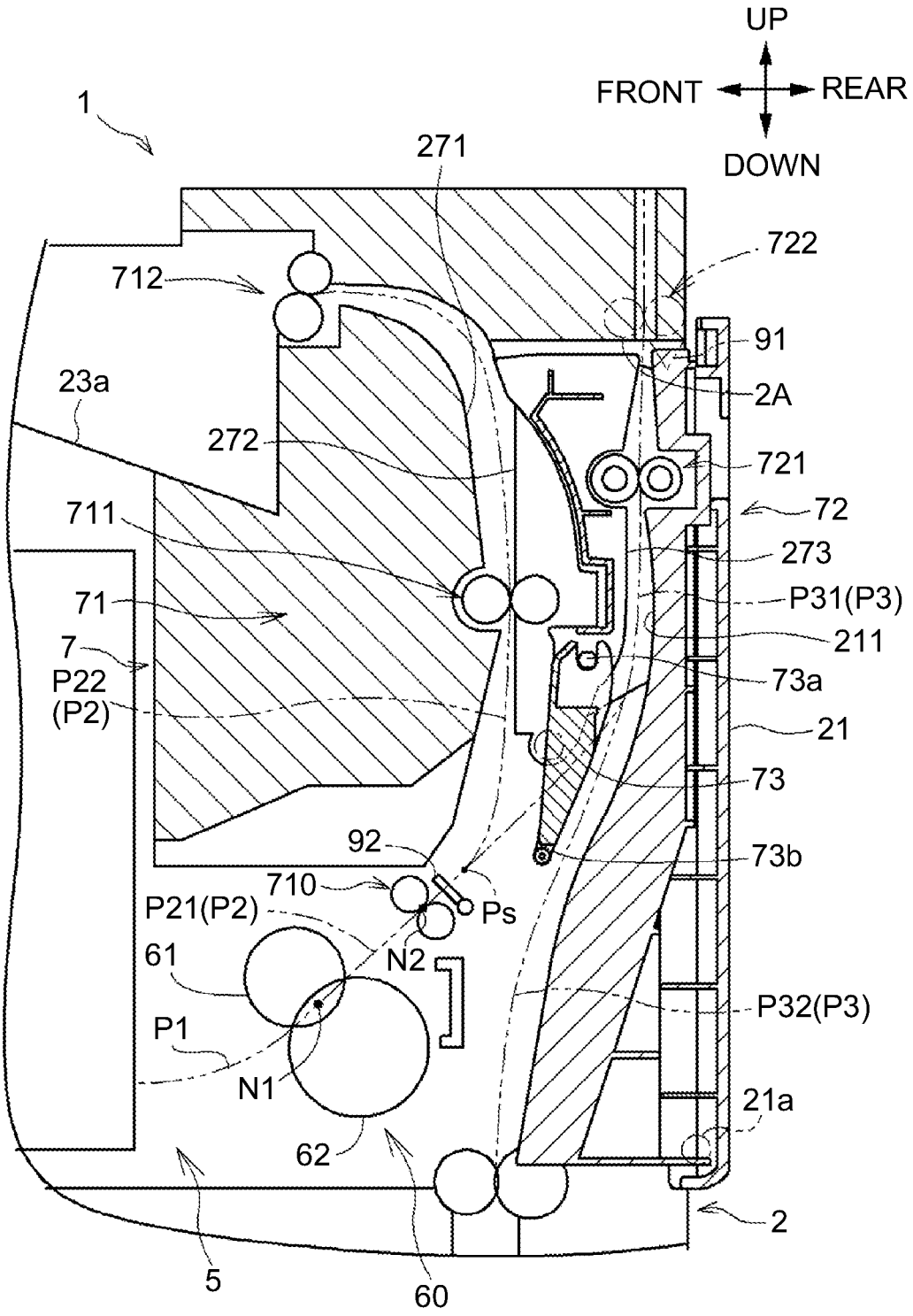
FIG. 2 is a cross-sectional side view of a transport unit of the image forming apparatus, with a rear cover closed and a flap located at a first position.

As shown in FIG. 1, an image forming apparatus according to an embodiment of the disclosure is an electrophotographic color laser printer for forming an image on a sheet S, such as a paper sheet and a transparency, by overlapping developing agent images of different colors. The image forming apparatus may be a monochrome laser printer for forming a monochrome developing agent image on a sheet.

In the following description, left and right sides of the page of FIG. 1, a side facing out of the page, and a side facing into the page are defined respectively as front, rear, left, and right sides of the image forming apparatus 1. Upper and lower sides of the page of FIG. 1 are defined respectively as upper and lower sides of the image forming apparatus 1.

The image forming apparatus 1 includes a housing 2, a feeder 3 configured to feed a sheet S, an image forming unit 5 configured to form an image on the sheet S, and a transport unit 7 configured to transport the sheet S transported from the image forming unit 5.

The housing 2 is a box having a substantially rectangular parallelepiped shape and stores therein the feeder 3, the image forming unit 5, and the transport unit 7. The housing 2 includes a first opening 2A open rearward, and a rear cover 21 openable and closable relative to the first opening 2A. In other words, the rear cover 21 is disposed at a rear end of the housing 2. The rear cover 21 is an example of a cover pivotable relative to a housing.

The rear cover 21 has a first pivot shaft or axis 21*a* located at its lower end and extending in the left-right direction. The rear cover 21 is pivotable about the first pivot axis 21*a* to be opened and closed relative to the housing 2. The first opening 2A is exposed when the rear cover 21 is open, and is covered when the rear cover 21 is closed. A top cover 23 covers an upper portion of the housing 2. The upper cover 23 includes a discharge tray 23*a* inclined downward from the front toward the rear so as to be recessed. In other words, the housing 2 includes, at its upper portion, the discharge tray 23*a*.

The feeder 3 includes a sheet cassette 31, a first feed roller 32, a separation roller 33, a separation pad 33*a*, a first transport roller pair 34, and a registration roller pair 35. The housing 2 defines therein a main transport path P1 for a sheet S traveling from the sheet cassette 31 via the image forming unit 5.

The sheet cassette 31 supports a stack of sheets S. The first feed roller 32, the separation roller 33, and the separation pad 33*a* feed one sheet S at a time from the sheet cassette 31 into the main transport path P1. The transport rollers 34 and the registration rollers 35 transport the sheet S fed into the main transport path P1 toward the image forming unit 5.

The housing 2 includes a second opening 2B open frontward, and a front cover 29 openable and closable relative to the second opening 2B. The front cover 29 has, at its lower end, a third pivot shaft or axis 29*a* extending in the left-right direction. The front cover 29 is pivotable about the third pivot axis 29*a* to be opened and closed relative to the housing 2. The second opening 2B is exposed when the front cover 29 is open, and covered when the front cover 29 is closed.

The feeder 3 includes a second feed roller 38 and a second transport roller pair 39. In a state where the front cover 29 is open, the second feed roller 38 moves down and feeds one of the sheets S placed on the front cover 29, and the second transport rollers 39 transport the sheet S into the main transport path P1. The registration rollers 35 transport the sheet S fed into the main transport path P1 toward the image forming unit 5.

The image forming unit 5 is disposed above the feeder 3 and includes four drum units 51 arranged in tandem in the front-rear direction. Each drum unit 51 corresponds to one of colors: black, yellow, magenta, and cyan. Each drum unit 51 includes a photosensitive drum 51*a*, a charger 51*b*, and a developing roller 51*c*.

The image forming unit 5 includes a scanner 52 and a fixer 60. The scanner 52 is disposed at an upper portion in the housing 2 and irradiates each photosensitive drum 51 based on image data by scanning at high speed a laser beam over its surface, via a polygon mirror, lenses, and reflection mirrors. The fixer 60 is disposed downstream of the most downstream one of the photosensitive drums 51*a* in a sheet transport direction.

A transfer belt 40 is disposed below the image forming unit 5 to define the main transport path P1 therebetween. The transfer belt 40 is stretched between a drive roller 41*a* and a driven roller 41*b* which is disposed further to the rear of the housing 2 than the drive roller 41*a*. A transfer roller 42 is disposed opposite to each photosensitive drum 51*a* with the transfer belt 40 therebetween.

In the image forming unit 5, the scanner 52 selectively irradiates a photosensitive drum 51*a* which is uniformly charged by a corresponding charger 51*b*. This irradiation selectively removes electric charges from the photosensitive drum 51*a*, thereby forming an electrostatic latent image on a surface of the photosensitive drum 51*a*.

A developing bias is applied to each developing roller 51*c*. When an electrostatic latent image formed on the photosensitive drum faces a corresponding developing roller 51*c*, the developing roller 51*c* supplies toner to the electrostatic latent image because of the electric potential difference. Consequently, a toner image is formed on the photosensitive drum 51*a*.

A sheet S transported by the transfer belt 40 toward the image forming unit 5 sequentially passes between the transfer belt 40 and the photosensitive drums 51*a*. When each photosensitive drum 51*a* faces the sheet, a toner image on a surface thereof is transferred onto the sheet S because of a transfer bias applied to a corresponding transfer roller 42.

The sheet S with the transferred toner images is transported to the fixer 60. The fixer 60 includes a heat roller 61 for heating the sheet S, and a pressure roller 62 disposed opposite to the heat roller 61. The heat roller 61 and the pressure roller 62 constitute a fixing roller pair. When the sheet S transported to the fixer 60 passes between the heat roller 61 and the pressure roller 62 which are in press-contact with each other, the toner images are thermally fixed to the sheet S.

The transport unit 7 transports the sheet S with the thermally fixed toner images downstream away from the image forming unit 5. The transport unit 7 includes a first transport unit 71 and a second transport unit 72.

The first transport unit 71 has a function of discharging a sheet S transported from the image forming unit 5 onto the discharge tray 23*a*. The second transport unit 72 has a function of returning a sheet S transported from the image forming unit 5 back to the image forming unit 5.

Instead of returning a sheet S to the image forming unit 5, the second transport unit 72 may have a function of transporting a sheet S transported from the image forming unit 5 toward an optional device disposed above the image forming apparatus 1. For example, an optional device may be a mail box including multiple sheet trays.

In a duplex mode where the image forming apparatus 1 forms images on both sides of a sheet S, the second transport unit 72 inverts and transports a sheet S having an image formed on one side by the image forming unit 5 back to the image forming unit 5. After the image forming unit 5 forms an image on the other side of the sheet S, the first transport unit 71 discharges the sheet S onto the discharge tray 23*a*. As compared with a case where the first transport unit 71 alone discharges and returns sheets S, the second transport unit 72, which is dedicated to return sheets S to the image forming unit 5, allows for the image forming apparatus 1 to transport more sheets per unit time in the duplex mode.

Transport Unit

The transport unit 7 will now be described. As shown in FIGS. 1-4, the transport unit 7 includes the first transport unit 71, the second transport unit 72, a flap 73, a first sensor 91, and a second sensor 92.

The first transport unit 71 includes a post-fixing roller pair 710, an intermediate discharge roller pair 711, and a discharge roller pair 712 which are disposed in this order on a downstream side of the fixer 60 in the sheet transport direction to transport a sheet S. The discharge roller pair 712 discharges the sheet S onto the discharge tray 23*a*. The post-fixing roller pair 710 is an example of a second transport roller pair which is disposed downstream of an image forming unit in a sheet transport direction to transport a sheet. The post-fixing roller pair 710 is disposed at an upper rear portion of the heat roller 61 and the pressure roller 62.

The first transport unit 71 defines a main transport path P21 for transporting a sheet S from the fixer 60 to the post-fixing roller pair 710, and a first discharge path P22 for discharging the sheet S guided from the post-fixing roller pair 710 onto the discharge tray 23*a*. A first transport path P2 of the first transport unit 71 includes the main transport path P21 and the first discharge path P22. A sheet S transported from the image forming unit is transported onto the discharge tray 23*a* along the first transport path P2. The main transport path P21 and the first discharge path P22 are each an example of a first transport path.

The main transport path P21 extends obliquely rearward and upward from the fixer 60 to the post-fixing roller pair 710. The first discharge path P22 extends upward from a downstream end of the main transport path P21, and then obliquely frontward and upward toward the discharge tray 23*a*. The intermediate discharge roller pair 711 is disposed in the middle of the first discharge path P22. The discharge roller pair 712 is disposed at a downstream end of the first discharge path P22.

In discharging a sheet S transported from the image forming unit 5 onto the discharge tray 23*a* in the image forming apparatus 1, the post-fixing roller pair 710 transports the sheet S having a toner image thermally fixed by the fixer 60 from the main transport path P21 into the first discharge path P22. Then the intermediate discharge roller pair 711 transports the sheet S along the first discharge path P22, and the discharge roller pair 712 discharges the sheet S onto the discharge tray 23*a*.

The second transport unit 72 defines a return path P3 which is branched from the first transport path P2 and along which a sheet S transported from the image forming unit 5 is transported back toward the image forming unit 5. The return path P3 is an example of a second transport path. The first transport path P2 and the return path P3 branch at a junction Ps. The return path P3 includes a first path P31 for transporting a sheet S transported from the image forming unit 5, and a second path P32 for returning a switched back sheet S toward the image forming unit 5. The first path P31 branches at the junction Ps from the first transport path P2 and extends upward at a position further to the rear of the housing 2 than the first transport path P2. The second path P32 branches from the first path P31 and extends downward. The first path P31 extends to an upper end of the housing 2. The second path P32 branches from the first path P31, extends downward, and then extends frontward below the sheet cassette 31 to reach the first transport roller pair 34.

The second transport unit 72 includes a first switchback roller pair 721 and a second switchback roller pair 722 which define the first path P31 of the return path P3. The first switchback roller pair 721 is an example of a first transport roller pair disposed at the second transport unit to transport a sheet. The second switchback roller pair 722 is disposed above the first switchback roller pair 721. The first switchback roller pair 721 and the second switchback roller pair 722 are supported by the housing 2. These switchback roller pairs 721 and 722 remain supported by the housing 2 in a state where the rear cover 21 is open.

The first switchback roller pair 721 and the second switchback roller pair 722 are configured to rotate in forward and reverse directions. The first and second switchback roller pairs 721 and 722 transport a sheet S along the first path P31 to an exterior of the housing 2 when rotating in the forward direction, and toward an interior of the housing 2 when rotating in the reverse direction.

The flap 73 is disposed at the junction Ps between the first transport path P2 and the return path P3. The flap 73 has, at its end, a first swing shaft or axis 73*a* parallel to the first pivot axis 21*a* and has, at its other end, a swing end portion 73*b*. The swing end portion 73*b* of the flap 73 is supported by the housing 2 swingably about the first swing axis 73*a*. The first swing axis 73*a* is located above the junction Ps and the swing end portion 73*b*.

Figure 3:
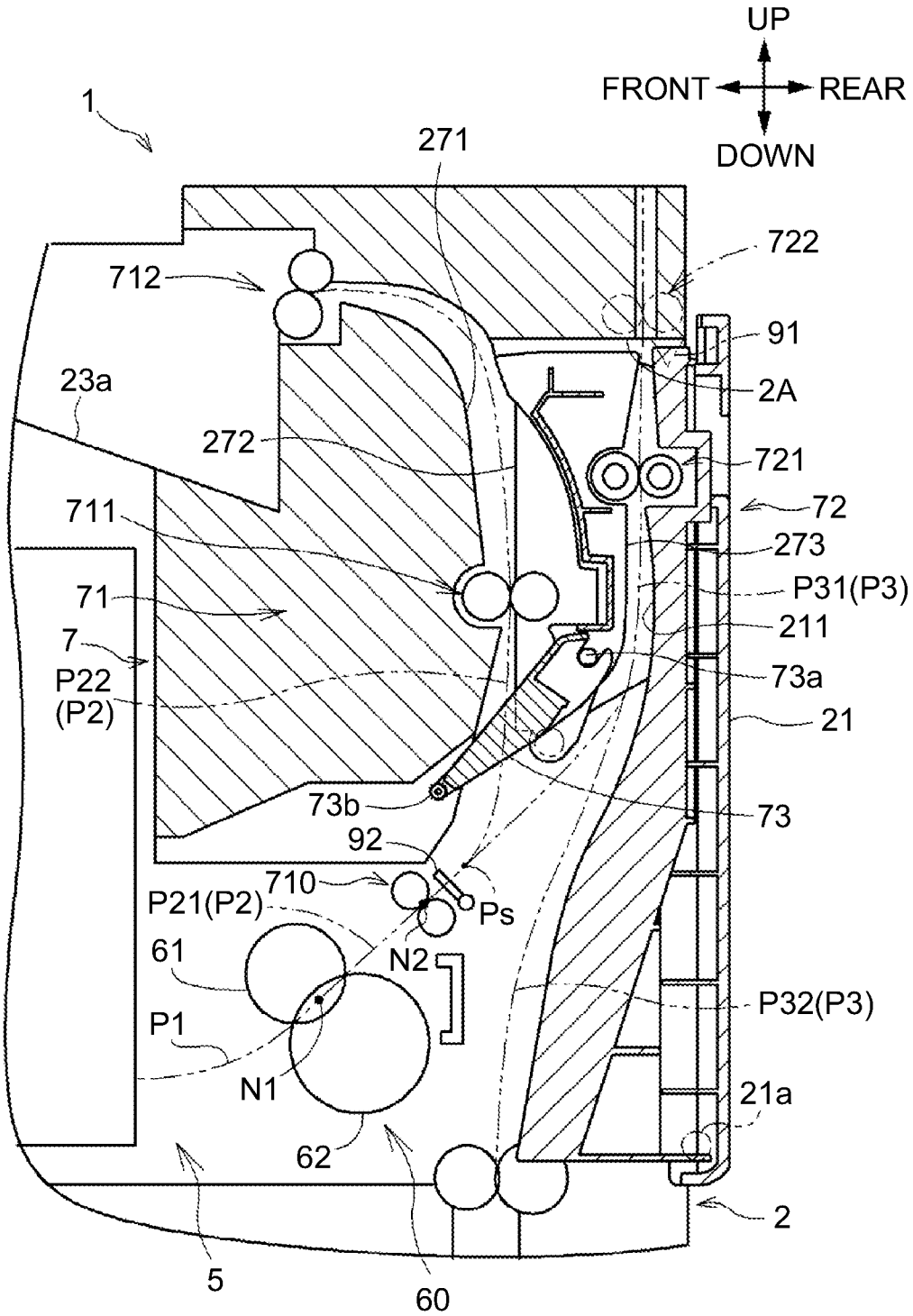
FIG. 3 is a cross-sectional side view of the transport unit, with the rear cover closed and the flap located at a second position.

The flap 73 is configured to swing about the first swing axis 73*a* between a first position (shown in FIG. 2) and a second position (shown in FIG. 3). The flap 73, when located at the first position, guides a sheet S transported from the image forming unit 5 into the first discharge path P22 and blocks the first path P31 of the return path P3 and, when located at the second position, guides the sheet S into the first path P31 and blocks the first discharge path P22. The swing end portion 73*b* is located at an upper position when the flap 73 is at the second position than when the flap 73 is at the first position.

The heat roller 61 and the pressure roller 62 of the fixer 60 define a first nip N1 therebetween. The post-fixing roller pair 710 defines therebetween a second nip N2. The second nip N2 is located downstream of and above the first nip N1. The flap 73 is disposed downstream of the post-fixing roller pair 710.

Figure 4:
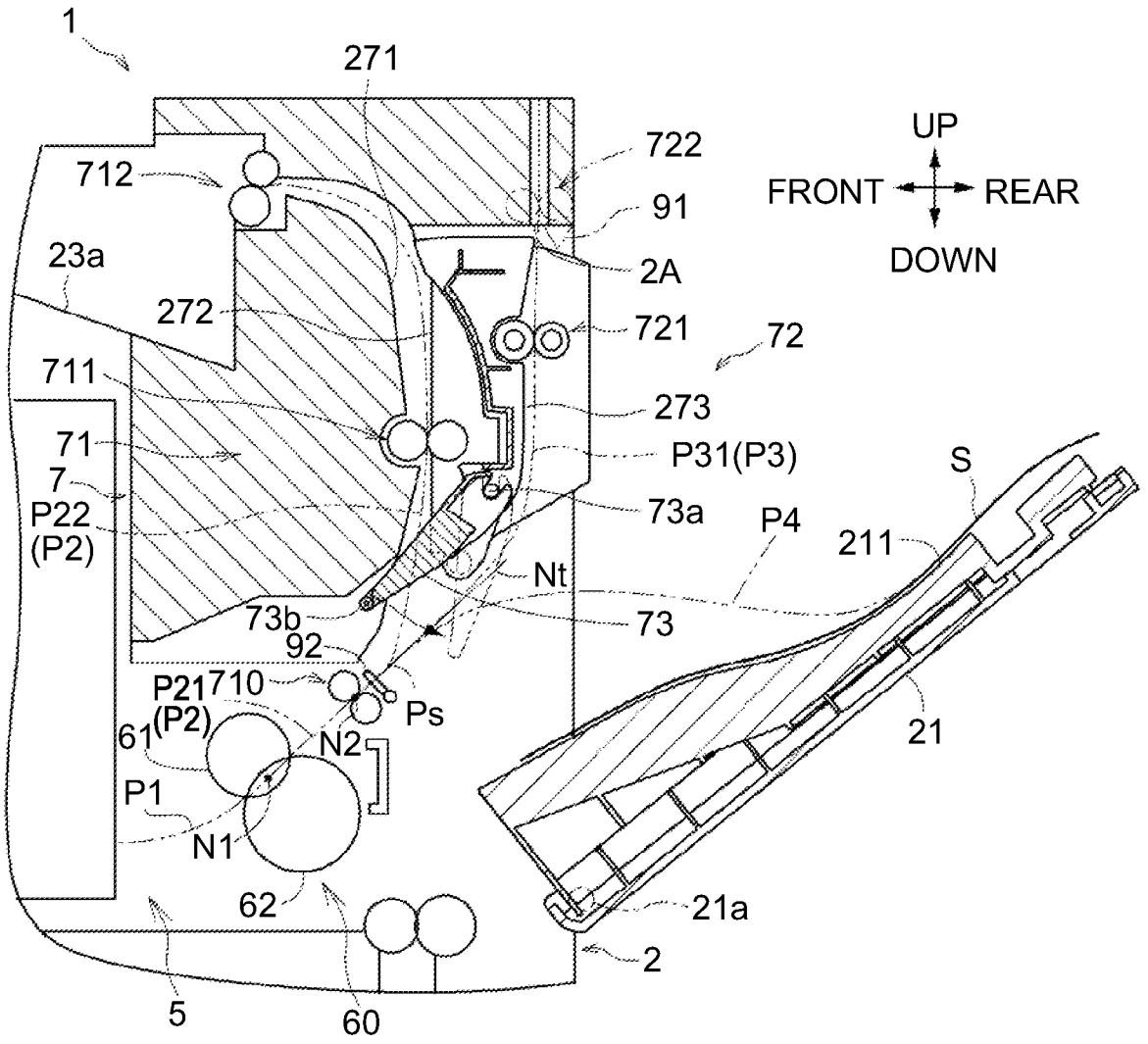
FIG. 4 is s cross-sectional side view of the transport unit, with the rear cover open and the flap located at the second position.

The swing end portion 73*b* of the flap 73 having moved to the second position is located on an upper side of a tangent Nt to the second nip N2 between the post-fixing roller pair 710 (refer to the flap 73 shown by a solid line in FIG. 4). In other words, the swing end portion 73*b* of the flap 73 at the second position is located opposite to the open first cover 21 relative to the tangent Nt. The swing end portion 73*b* of the flap 73 having moved to the first position is located on a lower side of the tangent Nt to the second nip N2 between the post-fixing roller pair 710 (refer to the flap 73 shown by a two-dot chain line in FIG. 4).

The first sensor 91 is disposed at an upper end of the opening 2A of the housing 2 to detect opening and closing of the rear cover 21. The second sensor 92 is disposed downstream of the post-fixing roller pair 710 in the sheet transport direction to detect the position of a sheet S being transported. The second sensor 92 is configured to detect a leading edge of a sheet transported by the post-fixing roller pair 710.

The housing 2 has a first guide surface 271, a second guide surface 272, and a third guide surface 273. The first guide surface 271 partially defines the first transport path P2 in the first transport unit 71. The second guide surface 272 is located further to the rear (i.e., closer to the rear end) of the housing 2 than the first guide surface 271 and partially defines the first transport path P2. The third guide surface 273 is located further to the rear (i.e., closer to the rear end) of the housing 2 than the second guide surface 272 and partially defines the return path P3. The rear cover 21 has a fourth guide surface 211 located further to the rear (i.e., closer to the rear end) of the housing 2 than the third guide surface 273 to partially define the return path P3.

The rear cover 21, when closed, defines at least a portion of the return path P3 and, when open, holds a sheet S transported from the image forming unit 5 to an exterior of the housing 2. When the rear cover 21 is open, the post-fixing roller pair 710 transports the sheet transported from the image forming unit 5 rearward to a position outside of the housing 2. In this case, the sheet S is transported to the rear cover 21 along a second discharge path P4, thereby being discharged straight.

Drive Unit of Flap

Figure 5:
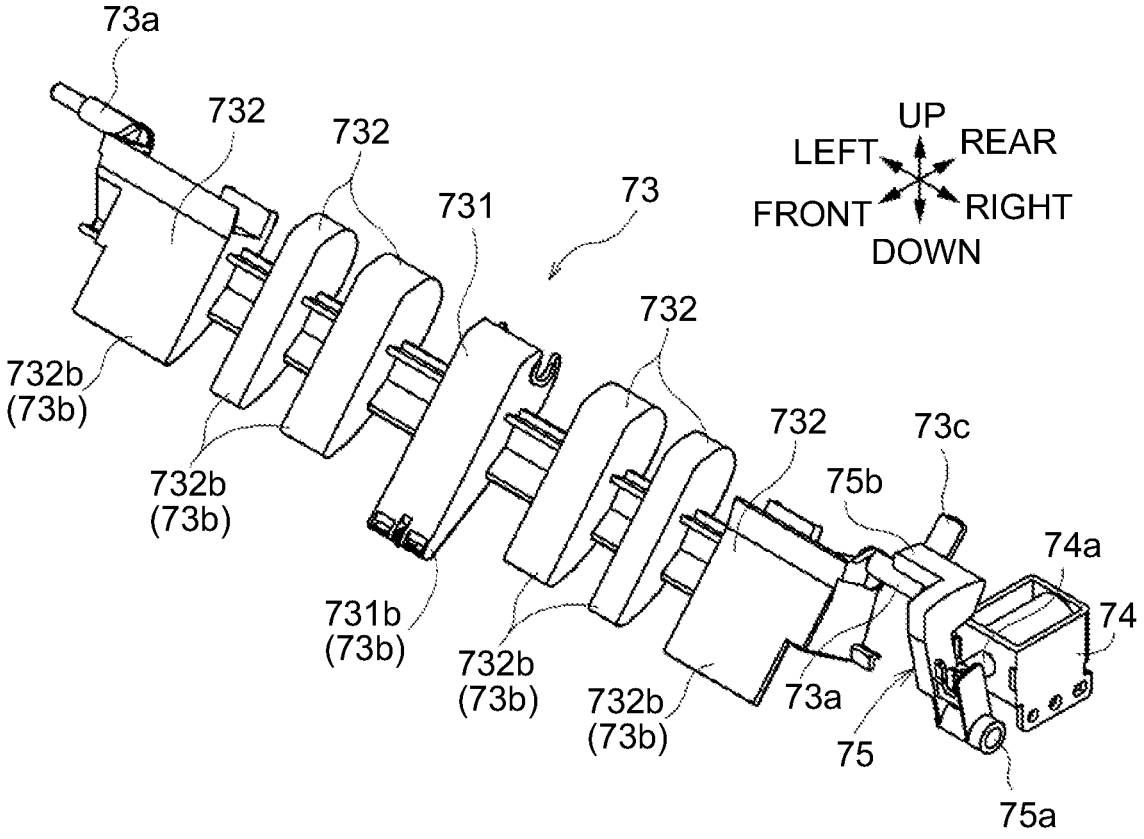
FIG. 5 is a perspective view of the flap.

As shown in FIGS. 5 and 6, the flap 73 includes, at its right end, an operation lever 73*c* extending rearward. The flap 73 is configured to swing to the first position by its own weight in a free state where no force is applied to the operation lever 73*c* in a pivoting direction.

The flap 73 includes a first flap member 731 disposed at its central portion in a width direction orthogonal to the sheet transport direction, and second flap members 732 disposed closer to its widthwise ends than the first flap member 731. A plurality of second flap members 732 are disposed on the left and right sides of the first flap member 731. When viewed in an axial direction of the first swing axis 73*a*, the length of each second flap member 732 from the first swing axis 73*a* to a swing end 732*b* is less than the length of the first flap member 731 from the first swing axis 73*a* to a swing end 731*b*. The swing end 732*b* of each second flap member 732 is located above the swing end 731*b* of the first flap member 731.

This may prevent or reduce interference of the flap 73 with other parts of the image forming apparatus 1 more than when the swing end 732*b* of each second flap member 732 is level with the swing end 731*b* of the first flap member 731. The flap 78 has a less moment of inertia when moving between the first position and the second position and thus readily moves therebetween.

Further, sheets pass through a central portion of the flap 73 in the width direction, regardless of the sheet size and type, and thus are reliably pushed by the flap 73.

The image forming apparatus 1 includes an electromagnetic solenoid 74 for driving the flap 73, and a drive lever 75 connected to the electromagnetic solenoid 74 so as to contact and swing the flap 73. The electromagnetic solenoid 74 is an example of a drive unit configure to move the flap 73 between the first position and the second position. The electromagnetic solenoid 74 and the drive lever 75 are supported by the housing 2.

The electromagnetic solenoid 74 includes an extendable plunger 74*a* connected to the drive lever 75. The drive lever 75 includes, at its one end, a second swing shaft or axis 75*a* and, at its other end, a contact portion 75*b* contactable with the operation lever 73*a*. When the drive lever 75 swings about the second swing axis 75*a*, the contact portion 75*b* is movable between a spaced position at which the contact portion 75*b* is spaced from the operation lever 73*c*, and a contact position at which the contact portion 75*b* contacts the operation lever 73*c* and pushes the operation lever 73*c* in the pivoting direction.

The plunger 74*a* extends when the electromagnetic solenoid 74 is unexcited, and retracts when the electromagnetic solenoid 74 is excited. The drive lever 75 moves to the spaced position when the plunger 74*a* extends, and moves to the contact position when the plunger 74*a* retracts.

Figure 6A:
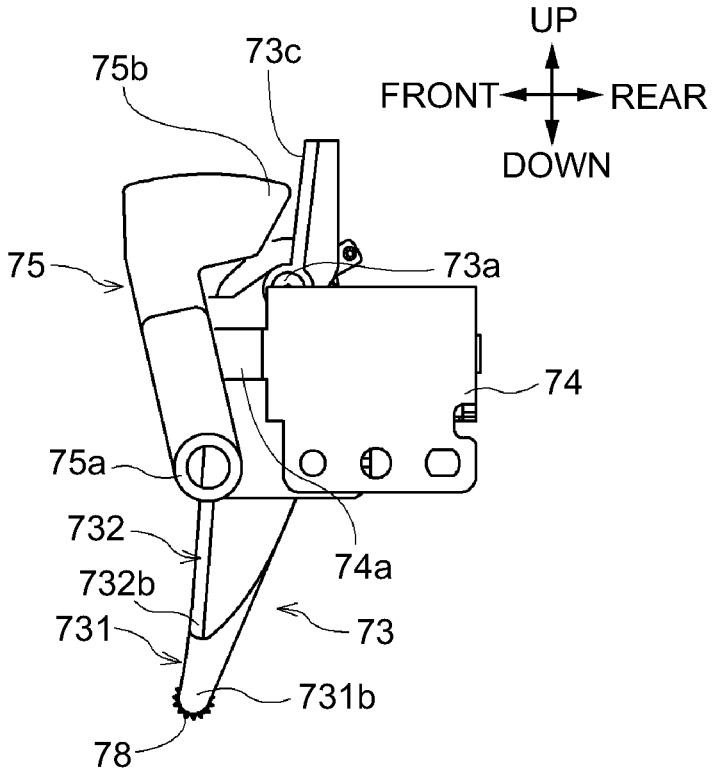
FIG. 6A is a side view of the flap switched into the first position by an electromagnetic solenoid.
Figure 6B:
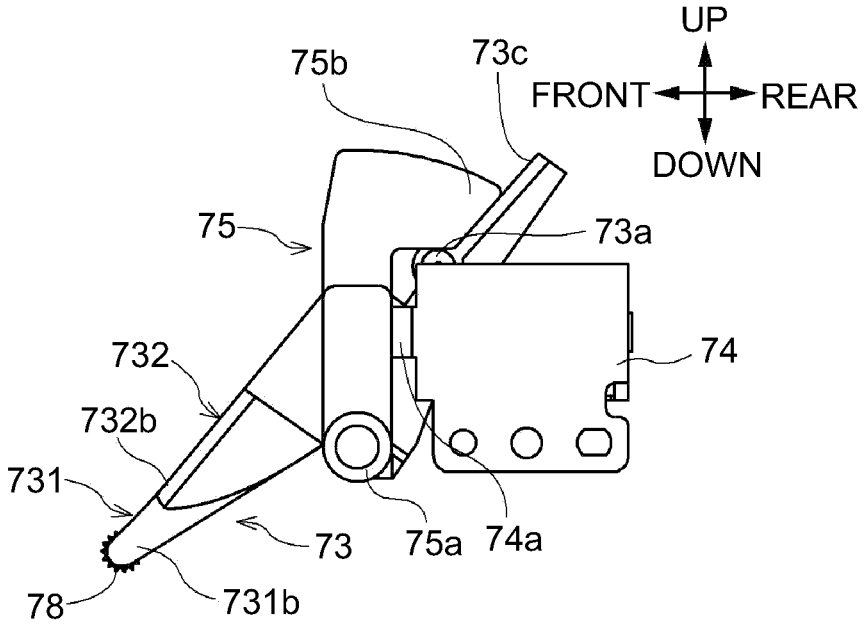
FIG. 6B is a side view of the flap switched into the second position by the electromagnetic solenoid.

As shown in FIG. 6A, when the electromagnetic solenoid 74 is unexcited, the drive lever 75 moves to the spaced position such that the contact portion 75*b* moves away from the operation lever 73*c*. This makes the flap 73 into a free state, thereby allowing the flap 73 to swing to the first position by its own weight. On the other hand, as shown in FIG. 6B, when the electromagnetic solenoid 74 is excited, the drive lever 75 moves to the contact position 75*b* such that the contact portion 75*b* pushes the operation lever 73*c* in the pivoting direction. Thus, the flap 73 swings from the first position to the second position. The electromagnetic solenoid 74 is configured to, when unexcited, switch the flap 73 into the first position and, when excited, switch the flap 73 into the second position.

Figure 7:
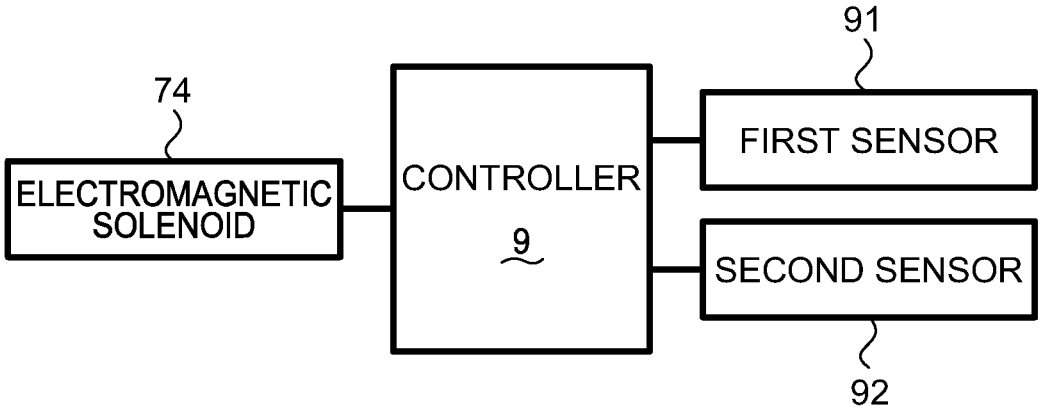
FIG. 7 is a block diagram showing a first sensor, a second sensor, and the electromagnetic solenoid which are connected to a controller.

As shown in FIG. 7, the image forming apparatus 1 includes a controller 9 which switches the electromagnetic solenoid 74 to move the flap 73, based on the results of detection by the first sensor 91 and the second sensor 92. The first sensor 91, the second sensor 92, and the electromagnetic solenoid 74 are connected to the controller 9.

In order for the image forming unit 5 to guide a sheet S into the first discharge path P22, the controller 9 switches the electromagnetic solenoid 74 into an unexcited state to cause the flap 73 to swing to the first position and block the first path P31 of the return path P3. In order for the image forming unit 5 to guide a sheet S into the first path P31 of the return path P3, the controller 9 switches the electromagnetic solenoid 74 into an excited state to cause the flap 73 to swing to the second position and block the first discharge path P22.

In the image forming apparatus 1, a time period for transporting a sheet S along the first transport path P2 with the flap 73 located at the first position is likely to be longer than a time period for transporting a sheet S along the return path P3 with the flap 73 located at the second position. Thus, the flap 73 is configured to be located at the first position when the electromagnetic solenoid 74 is unexcited. This may reduce a time period during which the electromagnetic solenoid 74 is excited, resulting in energy saving.

Controller for Switching Electromagnetic Solenoid

When sheets are discharged to an exterior of the housing 2 with the rear cover 21 open, the controller 9 executes switching of the electromagnetic solenoid 74, to thereby move the flap 73.

When the first sensor 91 detects opening of the rear cover 21, the controller 9 switches the electromagnetic solenoid 74 to move the flap 73 to the second position. When the second sensor 92 detects the position of a sheet S and the controller 91 determines that a leading edge of the sheet S reaches a position downstream of the swing end portion 73*b* of the flap 73, the controller 9 switches the electromagnetic solenoid 74 to move the flap 73 from the second position to the first position.

Figure 8:
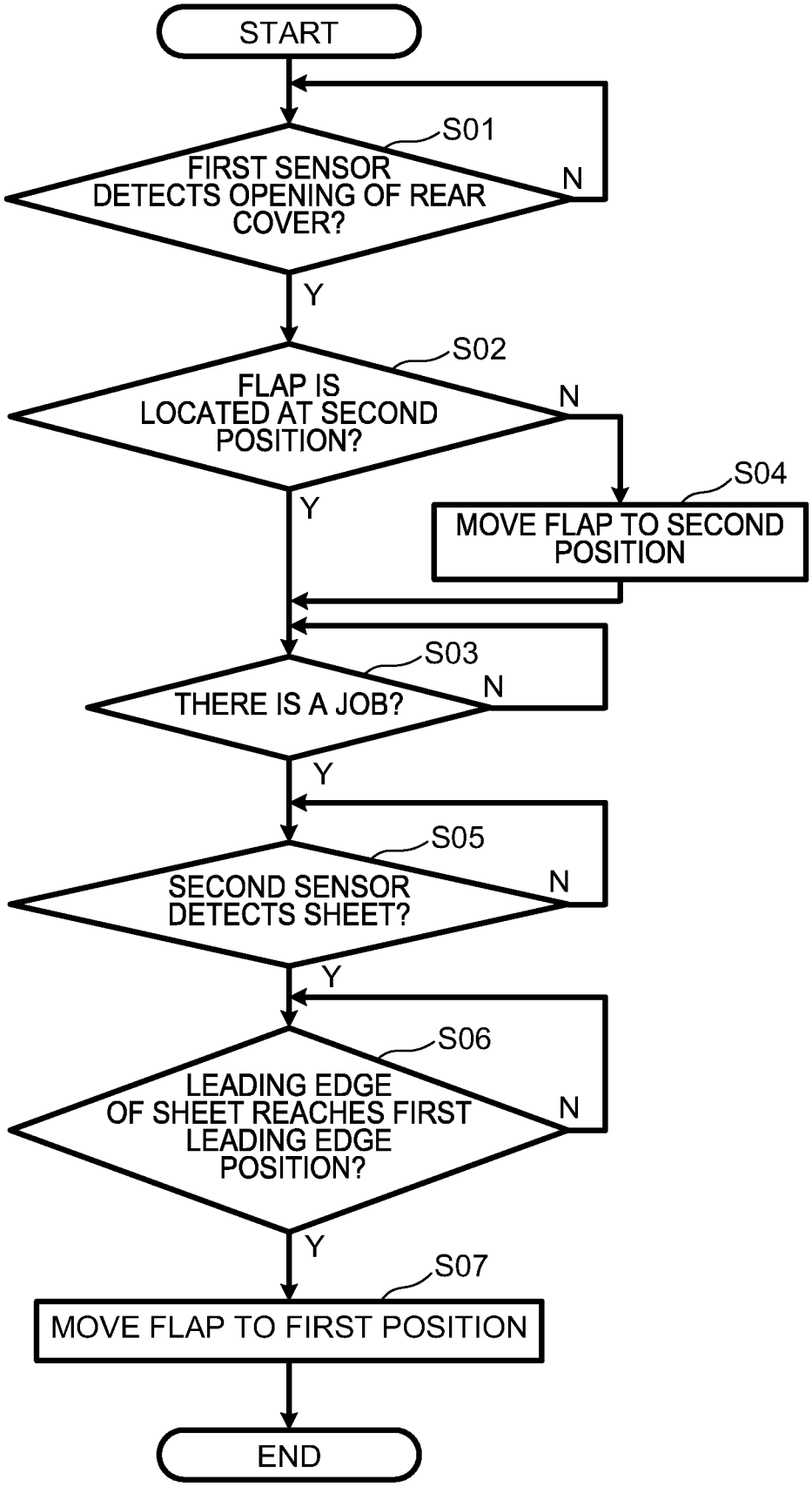
FIG. 8 is a flowchart showing control by the controller to switch the electromagnetic solenoid.

Referring now to FIG. 8, control by the controller 9 to switch the electromagnetic solenoid 94 will be described in detail. The electromagnetic solenoid 94 is initially switched in an unexcited state.

First, the controller 9 determines whether the first sensor 91 detects opening of the rear cover 21 (step S01). Upon determining that the first sensor 91 does not detect opening of the rear cover 21 in step S01 (step S01: N), the controller 9 executes step S01 again.

In contrast, upon determining that the first sensor 91 detects opening of the rear cover 21 in step S01 (step S01: Y), the controller 9 determines whether the flap 73 is located at the second position (step S02). The position of the flap 73 is determined based on a status of the electromagnetic solenoid 74. Upon determining that the flap 73 is located at the second position in step S02 (step S02: Y), the controller 9 determines that it is not necessary to move the flap 73. Subsequently, the controller 9 determines whether there is a job for the image forming unit 5 (step S03).

Upon determining that the flap 73 is not located at the second position in step S02 (step S02: N), the controller 9 determines that it is necessary to move the flap 73 and switches the electromagnetic solenoid 74 from unexcited to excited to move the flap 73 to the second position (step S04).

In short, when the controller 9 determines that the rear cover 21 is opened based on the detection result by the first sensor 91 and that it is necessary to move the flap 73, the controller 9 switches the electromagnetic solenoid 74 to move the flap 73 to the second position.

After moving the flap 73 to the second position, the controller 9 determines whether there is a job for the image forming unit 5. Upon determining that there is no job for the image forming unit 5 in step S03 (step S03: N), the controller 9 executes step S03 again. In contrast, upon determining that there is a job for the image forming unit 5 in step S03 (step S03: Y), the controller 9 determines whether the second sensor 92 detects a sheet S (step S05). Upon determining that the second sensor 92 does not detect a sheet S in step S05 (step S05: N), the controller 9 executes step S5 again.

When the image forming apparatus 1 executes a job, the image forming unit 1 forms an image on a sheet S and the sheet S with the image formed thereon is transported downstream from the image forming unit 5. When the post-fixing roller pair 710 transports the sheet S downstream, the second sensor 92 detects a leading edge of the sheet S.

Upon determining that the second sensor 92 detects the sheet S in step S05 (step S05: Y), the controller 9 determines whether a leading edge of the sheet S reaches a first leading edge position. Herein, the first leading edge position refers to a position where a leading edge of a sheet S reaches the swing end portion 73*b* of the flap 73 hypothetically located at the first position. In other words, the first leading edge position coincides with the position of the swing end portion 73*b* of the flap 73 located at the first position.

For example, the controller 9 may calculate, using the transport speed of a sheet S and a distance from the second sensor 92 to the first leading edge position, a time period taken for a leading edge of a sheet S to reach the first leading edge position after the detection of the leading edge by the second sensor 92. In this case, the controller 9 determines that the leading edge of the sheet S reaches the first leading edge position upon elapse of the calculated time period after the detection of the leading edge by the second sensor 92.

In other words, the controller 9 may determine a lapsed time since the second sensor 92 detects the leading edge of the sheet S. Then, the controller 9 may determine whether the lapsed time reaches a particular time. If the lapsed time reaches the particular time, the controller 9 determines that the leading edge of the sheet S reaches the first leading edge position. The particular time is determined such that the leading edge of the sheet S reaches the first leading edge position, at a timing when the particular time elapses since the second sensor 92 detects the leading edge of the sheet S, where the swing end portion 73*b* of the flap 73 would locate when the flap 73 is at the first position.

The particular time X is expressed by the following formula:

$X=Z/Y$, where Y is the transport speed of a sheet S, and Z is a distance from the second sensor 92 to the first leading edge position.

Upon determining that the leading edge of the sheet S does not reach the first leading edge position in step S06 (step S06: N), the controller 9 executes step S06 again. In contrast, upon determining that the leading edge of the sheet S reaches the first leading edge position in step S06 (step S06: Y), the controller 9 determines that the leading edge of the sheet S reaches a position downstream of the swing end portion 73*b* of the flap 73 and switches the electromagnetic solenoid 74 from excited to unexcited to move the flap 73 from the second position to the first position (step S07).

In short, when the controller 9 determines that the leading edge of the sheet S reaches the position downstream of the swing end portion 73*b* of the flap 73 at the second position, based on the detection result by the second sensor 92, the controller 9 switches the electromagnetic solenoid 74 to move the flap 73 from the second position to the first position.

When sheets are discharged straight to an exterior of the housing 2, the controller 9 controls switching of the electromagnetic solenoid 74 so as to keep the flap 73 at the second position until the leading edge of the sheet S reaches a position downstream of the swing end portion 73*b* of the flap 73. The flap 73 at the second position blocks the first transport path P2 to prevent entry of the leading edge of the sheet S into the first transport path P2. After the leading edge of the sheet S reaches the position downstream of the swing end portion 73*b* of the flap 73, the flap 73 moves from the second position to the first position to block the return path P3, thereby preventing entry of the sheet S into the return path P3. This may enable proper transport of the sheet S to an exterior of the housing 2.

In this case, if the swing end portion 73*b* of the flap 73 overtakes a leading edge of a sheet S and moves into a position downstream of the leading edge, the sheet S may enter the first transport path P2.

Figure 9A:
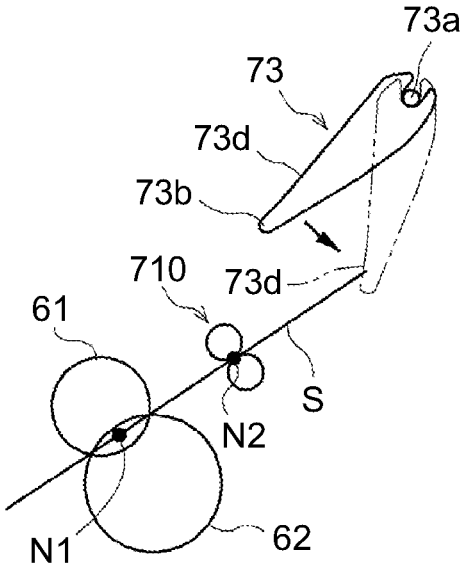
FIGS. 9A and 9B are schematic views of the flap moving from the second position to the first position after a leading edge of a sheet reaches a first leading edge position.
Figure 9B:
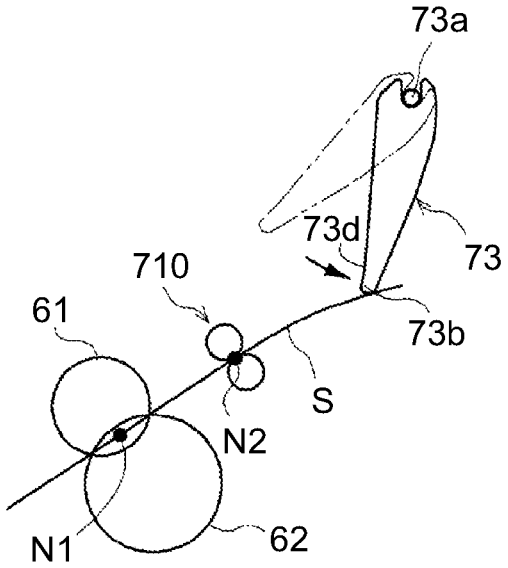

In this embodiment, however, as shown in FIG. 9A, the flap 73 is caused to move from the second position to the first position after a leading edge of a sheet S reaches the first leading edge position. Thus, as shown in FIG. 9B, the swing end portion 73*b* of the flap 73 moving to the first position is unlikely to overtake the leading edge of the sheet S. This may further prevent entry of the sheet S into the first transport path P2 and the return path P3, enabling proper transport of the sheet S.

Particularly, as shown in FIG. 9A, by moving the flap 73 from the second position to the first position after a leading edge of a sheet S reaches the position of an upstream side surface 73*d* of the swing end portion 73*b* of the flap 73 hypothetically located at the first position, the swing end portion 73*b* of the flap 73 is unlikely to overtake the leading edge of the sheet S. This may prevent entry of the sheet S into the first transport path P2 and the return path P3.

When the rear cover 21, which partially constitutes the second transport unit 72, is opened, the return path P3 is exposed and the first switchback roller pair 721 remains supported by the housing 2. Unlike in this embodiment, if the flap 73 is located at the second position when a sheet S is transported downstream by the post-fixing roller pair 710 with the rear cover open 21, the sheet S may enter the first path P31 of the return path P3 and be transported by the first switchback roller pair 721.

In this embodiment, however, when the leading edge of the sheet S reaches to a position downstream of the swing end portion 73*b* of the flap 73, the flap 73 is caused to move from the second position to the first position to block the return path P3, thereby preventing entry of the sheet S into the return path P3. This may enable proper transport of the sheet S. When the rear cover 21 is opened, the first switchback roller pair 721 remains at the housing 2, instead of moving together with the rear cover 21. This may simplify in structure the first switchback roller pair disposed at the housing 2.

After determining that a leading edge of a sheet S has reached a position downstream of the swing end portion 73*b* of the flap 3, the controller 9 causes the flap 73 to move from the second position to the first position. As shown in FIG. 4, the flap 73 moving from the second position to the first position crosses the tangent Nt to the nip N2 between the post-fixing roller pair 710.

By crossing the nip tangent Nt, the swing end portion 73*b* of the flap 73 is allowed to move in contact with the sheet S. Thus, the flap 73 moves from the second position to the first position, the swing end portion 73*b* pushes down the sheet S. This may further prevent entry of the sheet S into the return path P3 and enable proper transport of the sheet S.

If the image forming apparatus 1 is not provided with the post-fixing roller pair 710, entry of a sheet S into the return path P3 may be prevented by the flap 73 which is configured to, when moving from the second position to the first position, cross a tangent to the first nip N1 between the heat roller 61 and the pressure roller 62.

Figure 10A:
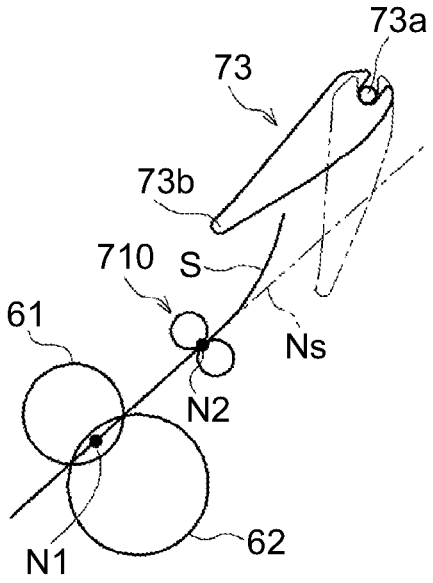
FIGS. 10A and 10B are schematic views showing a swing end portion of the flap located at the first position pushes down a sheet to bend the sheet in a direction opposite to a direction in which the sheet is curled by image forming.
Figure 10B:
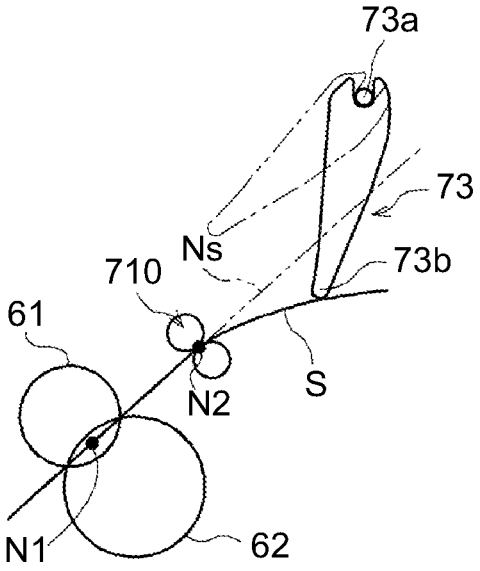

As shown in FIG. 10A, in the image forming apparatus 1, the swing end portion 73*b* of the flap 73 at the second position is located on an upper side of a nip straight line Ns passing through the first nip N1 between the heat roller 61 and the pressure roller 62 and the second nip N2 between the post-fixing roller pair 710. As shown in FIG. 10B, the swing end portion 73*b* of the flap 73 at the first position is located on a lower side of the nip straight line Ns.

As shown in FIG. 10A, when a sheet S having an image formed thereon by the image forming unit 5 is heated by the fixer 60 for image fixing, the sheet S tends to be curled such that a concave sheet surface faces up. As shown in FIG. 10B, the flap 73 is configured such that, when at the first position, the swing end portion 73*b* is located on a lower side of the nip straight line Ns. The swing end portion 73*b* of the flap 73 at the first position pushes down the sheet S at a position downstream of the post-fixing roller pair 710. The swing end portion 73*b* bends the sheet S such that a concave sheet surface faces down. In other words, the swing end portion 73*b* bends the sheet S in a direction opposite to a direction in which the sheet S is curled, thereby correcting curling of the sheet S.

Figure 11A:
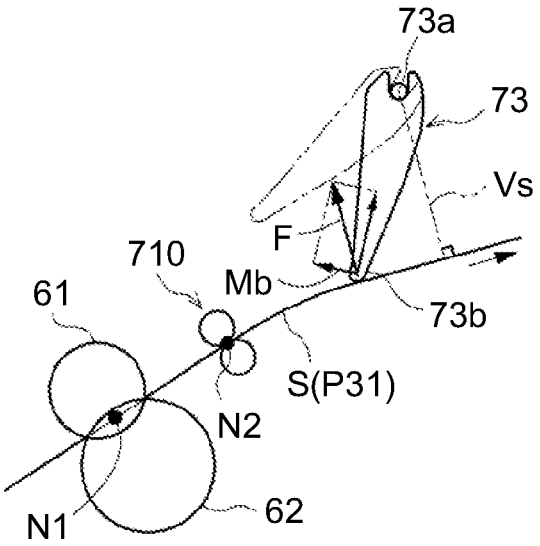
FIG. 11A is a schematic side view showing that the flap at the first position is located upstream of an imaginary straight line.

As shown in FIG. 11A, the flap 73 at the first position is located upstream, in the first path P31 of the return path P3, of an imaginary straight line Vs passing through the first swing axis 73*a* and perpendicular to the sheet S being transported.

Figure 11B:
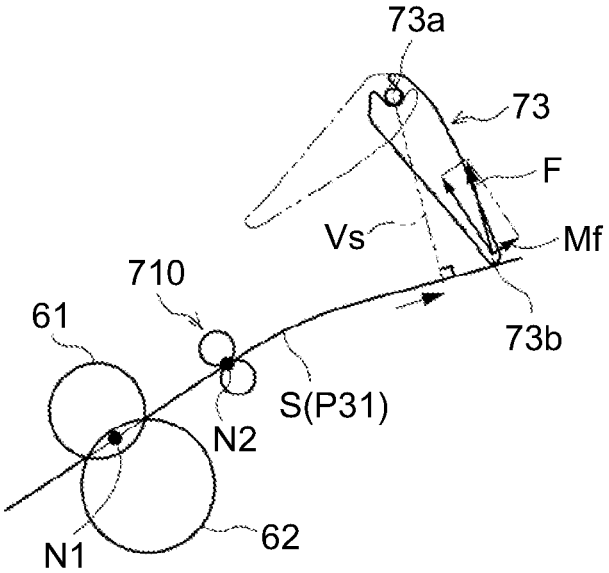
FIG. 11B is a schematic side view showing that if the flap at the first position is located downstream of an imaginary straight line, a moment acts on the flap in a direction further pivoting toward the first position.

As shown in FIG. 11B, when the swing end portion 73*b* of the flap 73 contacts the sheet S transported along the first path P31 of the return path P3, the flap 73 receives an upward force F from the sheet S. In this case, if the swing end portion 73*b* of the flap 73 is located downstream of the imaginary straight line Vs in the sheet transport direction, a moment Mf acts on the flap 73 in a direction pivoting about the first swing axis 73*a* beyond the first position. Nevertheless, the flap 73 is unable to pivot any further and may be broken.

In contrast, as shown in FIG. 11A, the swing end portion 73*b* of the flap 73 is located upstream of the imaginary straight line Vs in the sheet transport direction, a moment Mb acts on the flap 73, due to a force from the sheet S, in a direction pivoting about the first swing axis 73*a* toward the second position. The flap 73 is pivotable from the first position to the second position without being broken.

Figure 12A:
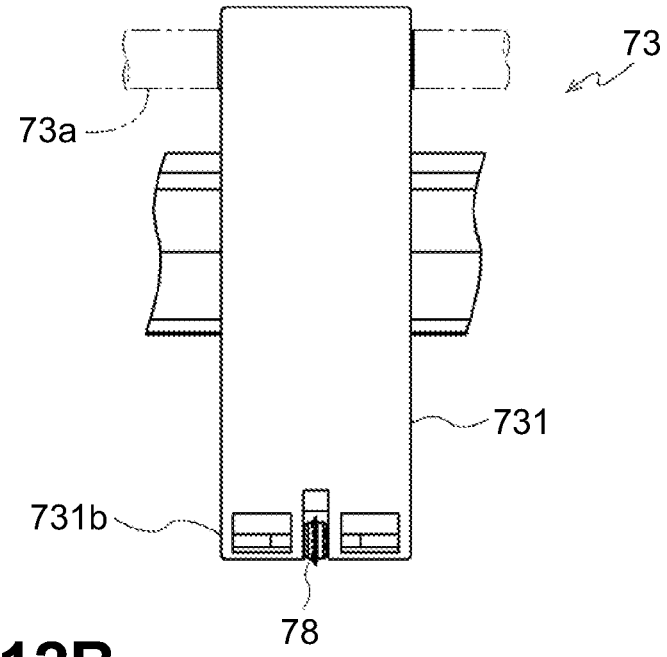
FIGS. 12A and 12B show a star wheel disposed at the swing end portion of the flap.
Figure 12B:
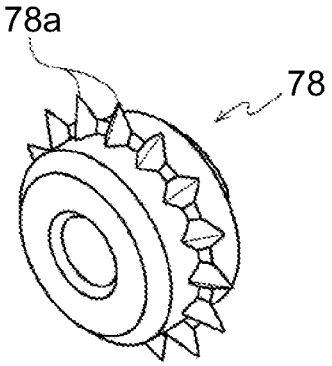

As shown in FIG. 12A, a star wheel 78 is disposed at the swing end portion 73*b* of the flap 73 rotatably about an axis parallel to the first swing shaft or axis 73*a*. When the swing end portion 73*b* of the flap 73 approaches a sheet S, the star wheel 78 contacts the sheet S. The star wheel 78 is an example of a roller. As shown in FIG. 8B, the star wheel 78 includes, at its outer circumference, a plurality of contact teeth 78*a* contactable with the sheet S.

The star wheel 78 rotatably disposed at the swing end portion 73*b* rotates when the sheet S contacts the swing end portion 73*b*. This may reduce the transport resistance to the sheet S and the sliding noise generated between the flap 73 and the transported sheet S, enabling proper transport of the sheet S.

Especially, when the star wheel 78 is used as a roller, the contact teeth 78*a* intermittently contact the sheet S, thereby further reducing the contact area with the sheet S and the transport resistance. When the swing end portion 73*b* of the flap 73 contacts an image-formed surface of the sheet S, the star wheel 78 has a reduced contact area with the sheet S and thus is less likely to affect the image-formed surface.

Although, in this embodiment, the second sensor 92 for detecting the position of a transported sheet S is disposed downstream of the post-fixing roller pair 710, the second sensor may be disposed elsewhere. For example, the second sensor 92 may be disposed downstream of the registration roller pair 35.

When the second sensor 92 is disposed downstream of the registration roller pair 35, the controller 9 may calculate, using the transport speed of a sheet S, the length of a sheet S in the transport direction, and a distance from the second sensor to the first leading edge position, a time period taken for a leading edge of the sheet S to reach the first leading edge position after the detection of a trailing edge of the sheet S by the second sensor 92. In this case, the controller 9 determines that the leading edge of the sheet S reaches the first leading edge position upon elapse of the calculated time period after the detection of the trailing edge by the second sensor 92. In this case, the controller 9 may calculate the length of the sheet S in the transport direction, using a time period from the detection by the second sensor of the leading edge of the sheet S until the detection of the trailing edge of the sheet S, and the transport speed of the sheet S.

While the disclosure has been described in detail with reference to particular examples, various changes, arrangements and modifications may be applied therein without departing from the spirit and scope of the disclosure.

What is claimed is:

1. An image forming apparatus comprising:

an image forming unit configured to form an image on a sheet;

a housing storing therein the image forming unit and including a discharge tray at an upper portion thereof, the housing having a particular end;

a first transport unit configured to transport, along a first transport path, the sheet transported from the image forming unit to the discharge tray;

a second transport unit configured to transport, along a second transport path, the sheet transported from the image forming unit, the second transport path being branched from a junction with the first transport path and extending upward at a position closer to the particular end of the housing than the first transport path;

a cover disposed at the particular end of the housing pivotably relative to the housing and configured to, when closed, at least partially constitute the second transport unit and, when open, hold the sheet transported from the image forming unit to an exterior of the housing;

a flap disposed at the junction and swingable between a first position and a second position, the flap being configured to:

when at the first position, block the second transport path and guide, along the first transport path, the sheet transported from the image forming unit, and when at the second position, block the first transport path and guide, along the second transport path, the sheet transported from the image forming unit;

a drive unit configured to move the flap between the first position and the second position;

a first sensor configured to detect opening and closing of the cover;

a second sensor configured to detect a position of the sheet transported toward the exterior of the housing; and a controller configured to switch the drive unit, based on results of detection by the first sensor and the second sensor, to move the flap, wherein the controller is configured to:

switch the drive unit to move the flap to the second position, upon determining it is necessary to move the flap to the second position, subsequent to determining that the cover is opened based on a detection result by the first sensor, and switch the drive unit to move the flap from the second position to the first position, upon determining, based on a detection result by the second sensor, that a leading edge of the sheet reaches a position downstream, in a sheet transport direction, of a swing end portion of the flap at the second position.

2. The image forming apparatus according to claim 1, wherein the second transport unit includes a first transport roller pair configured to transport the sheet, the first transport roller pair being supported by the housing when the cover is open.

3. The image forming apparatus according to claim 1, wherein the first transport unit includes a second transport roller pair disposed downstream of the image forming unit in the sheet transport direction and configured to transport the sheet, wherein the flap is configured to cross a tangent to a nip between the second roller pair when the flap is moved from the second position to the first position upon determination by the controller that the leading edge of the sheet reaches the position downstream of the swing end portion of the flap at the second position.

4. The image forming apparatus according to claim 1, wherein the controller is configured to switch the drive unit to move the flap from the second position to the first position upon determining, based on the detection result by the second sensor, that the leading edge of the sheet reaches a first leading edge position which coincides with a position of the swing end portion of the flap located at the first position.

5. The image forming apparatus according to claim 1, wherein the flap at the first position is located upstream, in the sheet transport direction along the second transport path, of an imaginary straight line passing through a swing axis of the flap and perpendicular to the sheet being transported.

6. The image forming apparatus according to claim 1, wherein the image forming unit is configured to place on the sheet a monochrome developing agent image or developing agent images of different colors, wherein the image forming apparatus further comprises:

a fixing roller pair defining a first nip therebetween; and a second transport roller pair disposed downstream of the fixing roller pair in the sheet transport direction and defining therebetween a second nip which is located upstream of the first nip, and wherein the flap is disposed downstream of the second transport roller pair and the swing end portion of the flap at the first position is located on a lower side of a straight line passing through the first nip and the second nip.

7. The image forming apparatus according to claim 1, wherein the flap includes a first flap member disposed at a central portion thereof in a width direction orthogonal to the sheet transport direction, and a second flap member disposed closer to a widthwise end thereof than the first flap member, and a length from a swing axis of the flap to a swing end of the second flap member is less than a length from the swing axis of the flap to a swing end of the first flap member.

8. The image forming apparatus according to claim 1, wherein the flap includes a rotatable roller disposed at the swing end portion thereof.

9. An image forming apparatus comprising:

an image forming unit configured to form an image on a sheet;

a housing storing therein the image forming unit and including a discharge tray at an upper portion thereof, the housing having a particular end;

a first transport unit configured to transport, along a first transport path, the sheet transported from the image forming unit to the discharge tray;

a second transport unit configured to transport, along a second transport path, the sheet transported from the image forming unit, the second transport path being branched from a junction with the first transport path and extending upward at a position closer to the particular end of the housing than the first transport path;

a cover disposed at the particular end of the housing and movable between an open position and a closed position;

a flap disposed at the junction and swingable between a first position and a second position, the flap being configured to:

when at the first position, block the second transport path and guide, along the first transport path, the sheet transported from the image forming unit, and when at the second position, block the first transport path and guide, along the second transport path, the sheet transported from the image forming unit;

a drive unit configured to move the flap between the first position and the second position;

a first sensor configured to detect whether the cover is open;

a second sensor configured to detect a leading edge of the sheet; and a controller configured to:

determine whether the flap is at the first position or the second position based on status of the drive unit;

determine a lapsed time since the second sensor detects the leading edge of the sheet;

upon determining that the flap is at the first position and that the cover is open, control the drive unit to move the flap to the second position; and upon determining that the flap is at the second position and the lapsed time is a particular time, control the drive unit to move the flap to the first position, wherein the particular time is determined such that the leading edge of the sheet reaches a position, at a timing when the particular time elapses since the second sensor detects the leading edge of the sheet, where a swing end portion of the flap is located when the flap is at the first position.

* * * * *